US005924751A

United States Patent [19]

Moore

[11] Patent Number: 5,924,751

[45] Date of Patent: Jul. 20, 1999

[54] PORTABLE DOOR LOCK ASSEMBLY

[75] Inventor: Edward V. Moore, Bedford, Ind.

[73] Assignee: Kenneth Emmons, Bedford, Ind.

[21] Appl. No.: 09/040,977

[22] Filed: Mar. 18, 1998

[51] Int. Cl.[6] ..... E05C 17/54

[52] U.S. Cl. ..... 292/339; 292/244; 292/262; 292/288; 292/DIG. 15

[58] Field of Search ..... 292/339, 338, 292/DIG. 15, 288, 258, 262, 244; 16/82; 70/DIG. 65

[56] References Cited

U.S. PATENT DOCUMENTS

| | | | |
|---|---|---|---|
| 1,681,834 | 8/1928 | Arends | 292/288 |
| 3,583,743 | 6/1971 | Newell | 292/339 |
| 4,078,836 | 3/1978 | Wilson | 292/259 R |
| 4,330,146 | 5/1982 | Sessions, Jr. | 292/258 |
| 4,653,785 | 3/1987 | Tobey | 292/258 |
| 5,294,159 | 3/1994 | Corrigan | 292/258 |
| 5,509,701 | 4/1996 | Reinhard | 292/259 |
| 5,547,236 | 8/1996 | Gregory | 292/148 |

*Primary Examiner*—Steven Meyers
*Assistant Examiner*—Clifford B. Vaterlaus
*Attorney, Agent, or Firm*—Plews Shadley Racher & Braun

[57] ABSTRACT

A portable door lock assembly for locking a door in a partially open attitude has an elongated base member with a length greater than the width of a standard door frame. First and second hollow members are secured to opposite ends of the base member. A pair of central hollow members are secured to the base member between the first and second hollow members. An elongated cup mount member is provided. The cup mount member has a cup for receiving the bottom of a door pivotally secured to one end. Its other end has an outer diameter smaller than the inner diameter of the first, second and central hollow members so the first, second and central hollow members can telescopingly receive the cup mount member. The cup mount member is telescopingly secured in the particular hollow member depending on the type of entryway and which side of the door is hinged to the frame. At no time during use does the door lock have to be bolted, screwed or otherwise fastened to the wall, door, or frame.

4 Claims, 4 Drawing Sheets

PORTABLE DOOR LOCK ASSEMBLY

BACKGROUND

The present invention pertains to door locks and more particularly pertains to a portable door lock for temporarily locking a door in a partially open attitude.

Sometimes it is desirable to prop open a door to vent smoke, gasses, or heat from the inside. Other times, during building maintenance for example, the door has to remain at least partly open for long periods of time so that hoses, extension cords, conduits, and so on can extend across the threshold without being crimped or deformed by the door. Carpet cleaning is one such example.

Vacuum hoses and power conduits connecting the operator's wand with the vacuum, which is located outside in a truck, must extend across the doorway. Thus, the door has to be at least partly open presenting an opportunity for unauthorized access to the building. Not only can this lead to theft and/or property damage, but it presents a safety problem to the operator as well as others inside the building. The fact that most maintenance work is done after regular business hours makes this problem all the more troublesome.

Therefore, it is desirable to provide a new door lock capable of locking any door, or suite of doors, in a partially open attitude. In addition to being able to lock the door in a partially open attitude, such a device also must be easy to transport door-to-door to allow cleaning specialists on the job protection irrespective of where they are doing their work. Ideally, a portable door lock should at no time during its use have to be bolted, screwed or otherwise fastened to the wall, door, or frame. Defacing the entryway is unacceptable. Of course, such a door lock should be simple to operate, strong and durable.

Therefore, it is highly desirable to provide a new portable door lock.

It is also highly desirable to provide a new portable door lock capable of locking any door, or suite of doors, in a partially open attitude.

It is also highly desirable to provide a new portable door lock capable of being conveniently transported door-to-door.

It is also highly desirable to provide a new portable door lock that does not deface the entryway during use.

It is also highly desirable to provide a new portable door lock that is simple to operate, strong and durable.

Finally, it is highly desirable to provide a new portable door lock that meets all of the above desired features.

SUMMARY

Therefore, it is an object of the invention to provide a new portable door lock.

It is also an object of the invention to provide a new portable door lock that is capable of locking any door, or suite of doors, in a partially open attitude.

It is also an object of the invention to provide a new portable door lock capable of being conveniently transported door-to-door.

It is also an object of the invention to provide a new portable door lock that does not deface the entryway during use.

It is yet another object of the invention to provide a new portable door lock that is simple to operate, strong and durable.

It is finally an object of the invention to provide a new portable door lock that meets all of the above desired features.

In the broader aspects of the invention there is provided a portable door lock comprising a base member with opposite ends. The opposite ends are separated a distance greater than the width of a door frame. An elongated cup mount member is provided. The cup mount member has a cup pivotally secured to one end for receiving the bottom of a door. An adjustable securing means for securing the cup mount member to the base member is provided, wherein the cup mount member is adjustably securable to the base member such that when the opposite ends of the base member abut the door frame, the cup is securable a distance from the door.

DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION

Figure 1:
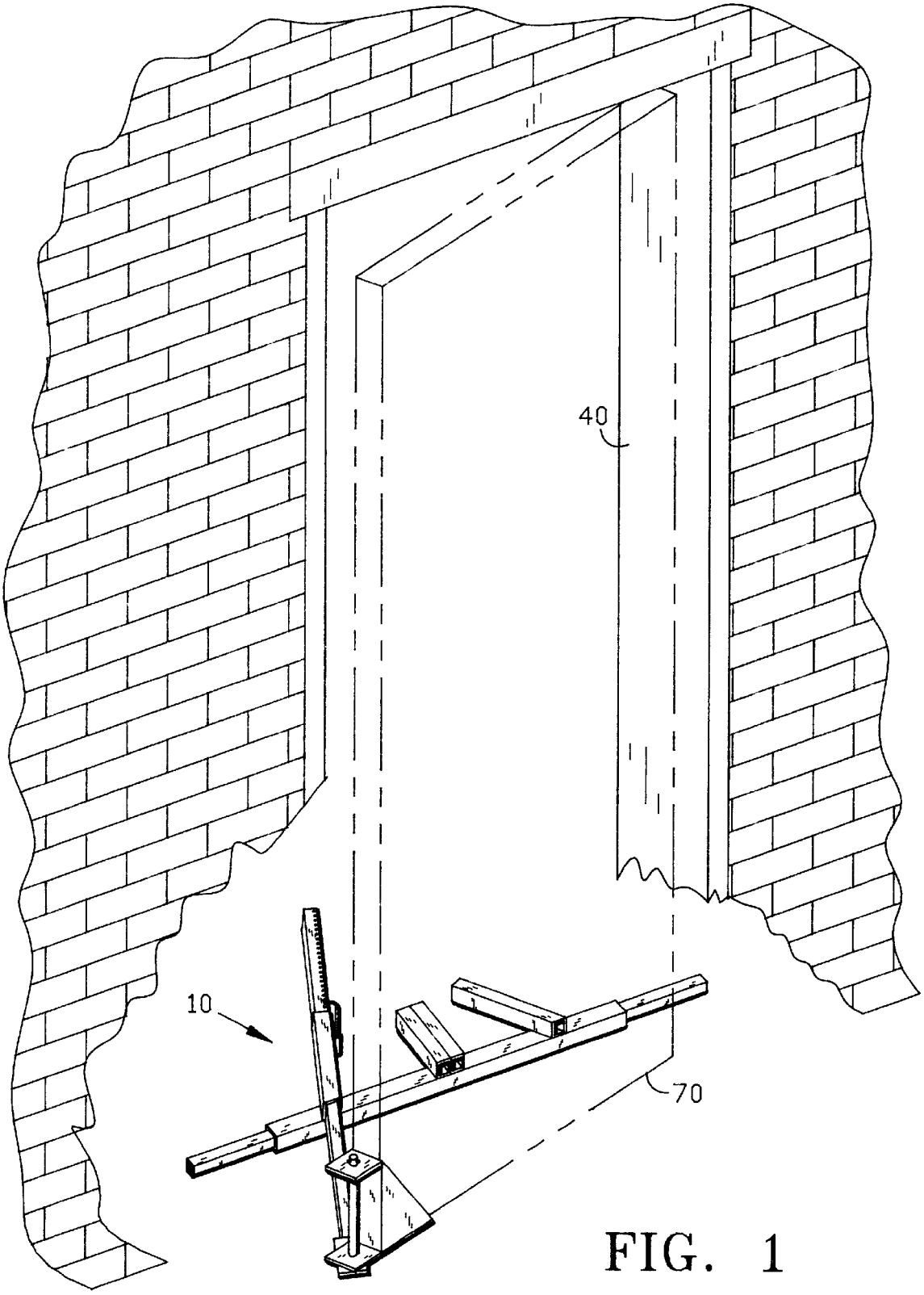
FIG. 1 is a perspective view of an embodiment of the invention shown in operation.
Figure 2:
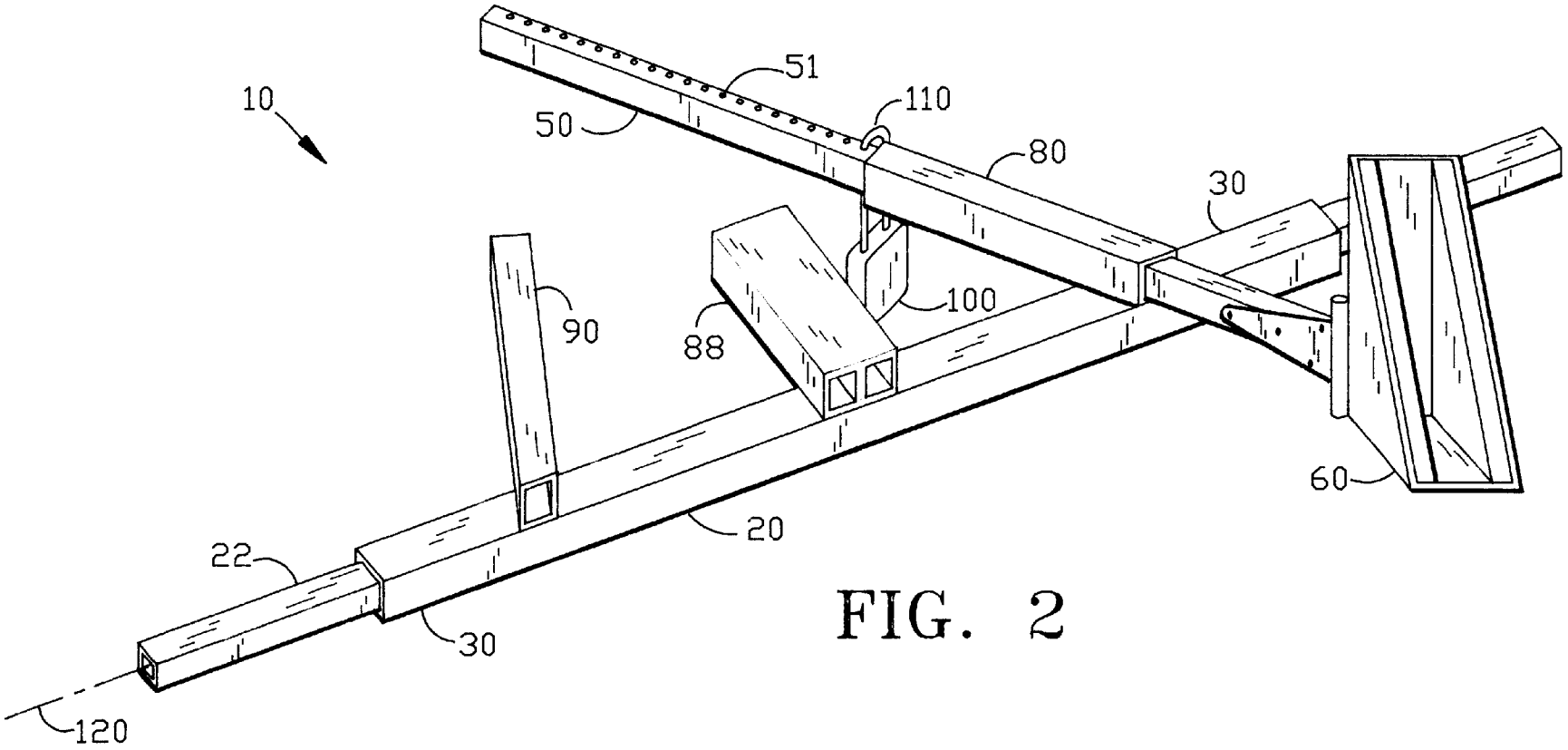
FIG. 2 is a side elevational perspective view of an embodiment of the invention.

FIGS. 1–5 show portable door lock assembly 10, including base member 20 with opposite ends 30. Base member 20 has extension member 22 telescopingly residing therein. In an embodiment, extension member 22 is a pair of hollow bars one residing telescopingly in each end 30 of base member 20. Of course, a single hollow bar having a length greater than base member 20 and residing in base member 20 may serve in place of a pair of same in each end 30. First and second hollow members 80,90 are secured to base member 20 generally at opposite ends 30. Cup mount member 50 has cup 60 pivotally secured to one end and bores 51 extending through it at its other end. Central hollow members 88 are secured to base member 20 between first and second members 80,90. Portable door lock 10 also includes lock 100 with shackle 110.

Base member 20, extension member 22, first, second and central hollow members 80, 90, and 88, respectively, cup mount member 50, and cup 60 are each formed from substantially rigid material such as aluminum or steel. Base member 20 is at least as long as the width of a standard door frame 40. First and second hollow members 80,90 are secured to base member 20 in an obliquely opposed configuration relative to longitudinal axis 120 of base member 20. The interior diameter of first and second hollow members 80,90 and central hollow members 88 is larger than the outer diameter of cup mount member 50. Lock 100 is a padlock.

Cup 60 is pivotally secured to cup mount member 50 using pivot means known in the art. In an embodiment, cup mount member 50 has upstanding pin 52 mounted thereto, as shown in FIG. 4. In that embodiment, cup 60 has rearwardly extending plates 56 with bores 57 formed therein for receiving pin 52. Pin 52 has bore 55, which also receives a pin 54. Pin 54 holds pin 52 in bores 57. It is important that pin 54 be welded or otherwise permanently secured within bore 55. In another embodiment, cup mount member 50 and cup 60 are secured together with hinge 58, as shown in FIG. 3, using means known to a skilled artisan.

Figure 5:
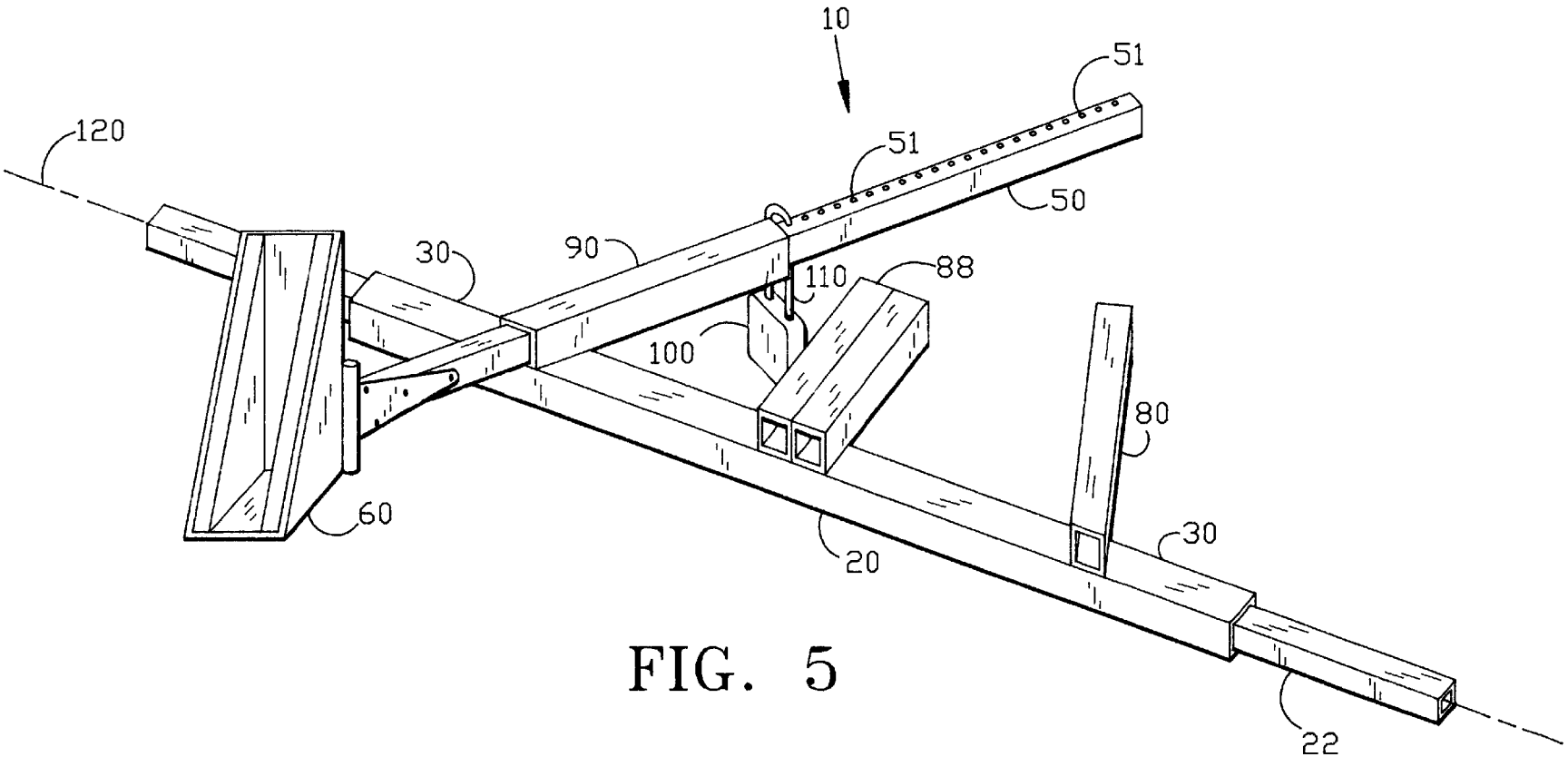
FIG. 5 is a side elevational perspective view of an embodiment of the invention.

In operation, portable door lock assembly 10 is positioned on the ground surface inside door frame 40, as shown in FIG. 1. To the extent that base member 20 may fit through door frame 40, extension members 22 are telescopingly withdrawn from within base member 20 as may be necessary. This ensures that base member 20, and thus portable door lock 10, cannot pass through door frame 40. Next, the end of cup mount member 50 opposite cup 60 is telescopingly positioned within second hollow member 90, as shown in FIG. 5. Cup mount member 50 is adjusted within second hollow member 90 by telescopingly sliding cup mount member 50 a distance so that cup 60 is proximate the bottom of door 70.

Note that for doors hinged on the side opposite that which is shown in FIG. 1, cup mount member 50 is positioned within first hollow member 80 instead of second hollow member 90, and in the case where two adjacent doors open opposite of each other, referred to as a suite of doors, typically of french style, (not shown), cup mount members 50 are positioned one each in the central hollow members 88. The method of using door lock 10 described below applies to each of these entryways with the only difference being the particular hollow member 80, 88, 90 that receives the cup mount member 50. Additionally, in the case of the suite of doors, two cup mount members 50 with cups 60 are required, one each telescopingly secured, respectively, within central hollow members 88.

Figure 3:
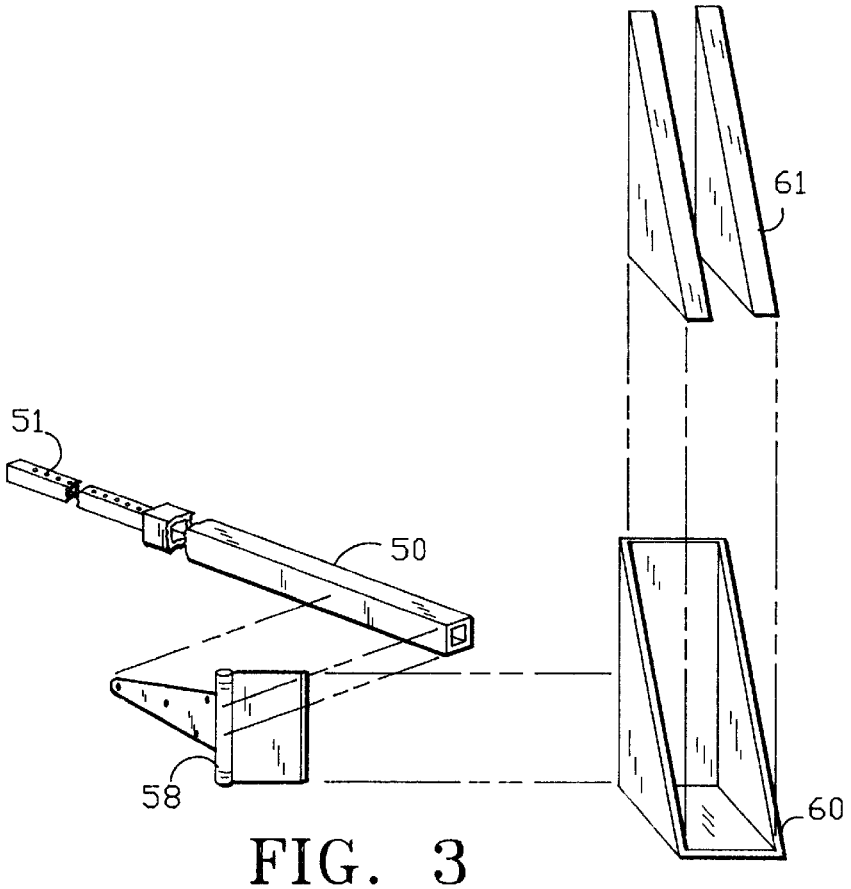
FIG. 3 is an elevated side perspective view showing an embodiment of the cup mount member and cup of the invention.
Figure 4:
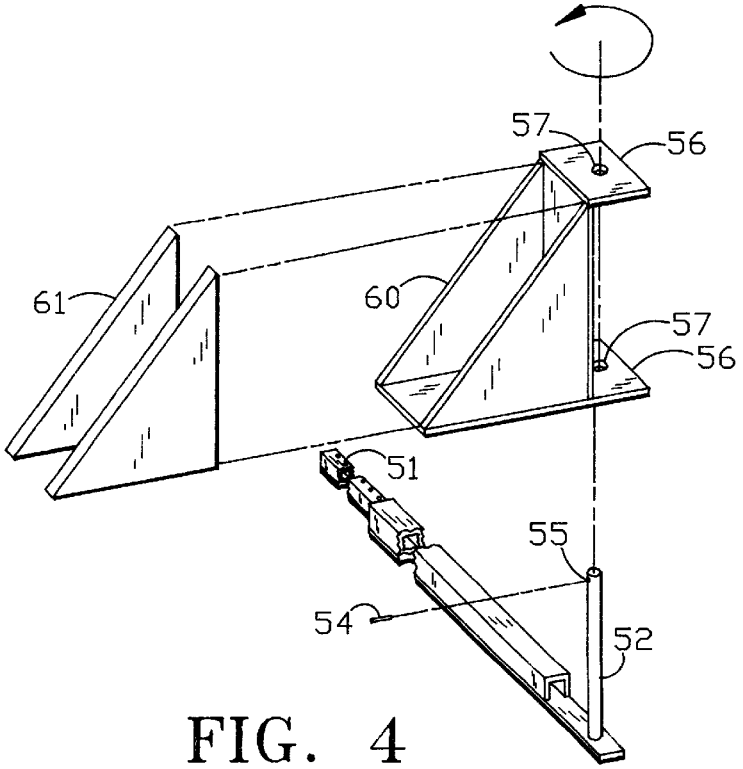
FIG. 4 is an elevated side perspective view showing another embodiment of the cup mount member and cup of the invention.

FIGS. 3 and 4 show different means for securing cup 60 to cup mount member 50 of the invention. It should be understood that other securing means known to those skilled in the art may be employed so long as cup 60 is capable of rotating a radius of between about zero degrees and about two hundred eighty degrees (0–280°) relative to cup mount member 50.

Referring to FIG. 1, once the bottom of door 70 is positioned in cup 60, cup mount member 50 is telescopingly adjusted inwardly. Door guards 61 may be positioned in cup 60 to protect opposite sides of door 70. Depending on the width of door 70, door guards 61 also may be used to more firmly secure door 70 within cup 60 as necessary. As the cup mount member 50 is telescoped inwardly, cup 60 is free to rotate relative to the cup mount member 50, and thus, cup 60 consistently maintains a perpendicular orientation relative to the bottom of door 70, as shown in FIG. 1. When the door is in the attitude desired, shackle 110 of lock 100 is secured in bores 51.

Removal of lock 100 from bores 51 and disengaging the bottom of door 70 from cup 60 enables the user to return door 70 to its closed position. Because cup 60 is secured for rotation to cup mount member 50 and cup mount member 50 is adjustably securable to base member 20 portable door lock 10 is capable of fastening any door in a partially open attitude. For the same reasons, cup mount member 50, in conjunction with base member 20, defines a wedge-like locking mechanism so that door lock 10 does not have to be bolted, screwed or otherwise fastened to the wall, door, or frame. Thus, portable door lock 10 will not deface the entryway. Moreover, first, central, and second hollow members 80,88,90, respectively, enable portable door lock 10 to be used in all entryways, including those having a suite of doors. Finally, portable door lock 100 is simple to operate, strong and durable.

While a specific embodiment of the invention has been shown and described herein for purposes of illustration, the protection afforded by any patent which may issue upon this application is not strictly limited to the disclosed embodiment, but extends to all structures and arrangements which fall fairly within the scope of the claims, which are appended hereto.

What is claimed is:

1. A portable door lock for use with a door and a door frame, the portable door lock comprising;

a base member with opposite ends, the opposite ends being separated a distance;

an elongated cup mount member having a cup end and an end opposite said cup end;

a cup for receiving the bottom of a door, the cup pivotally secured to said cup end;

a first hollow member secured to one end of the base member for telescopingly receiving the cup mount member;

a second hollow member secured to the other end of the base member also for telescopingly receiving the cup mount member, said first and said second hollow members being secured to the base member in an obliquely opposed fashion relative to a longitudinal axis of the base member, wherein the cup mount member is adjustably securable within one of said first and said second hollow members such that the opposite ends of said base member are adapted to abut said door frame, and said cup is adapted to be secured a distance from the door regardless which side of said door is hinged to said frame; and, a pair of central hollow members secured to the base member between said first and second hollow members, said central hollow members and said base member and said first member and said second member each having the same interior diameter.

2. The portable door lock of claim 1 wherein said cup mount member having a plurality of spaced bores extending therethrough, a lock with a shackle for locking the cup mount member within one of the first and second hollow members, wherein the distance between the cup and the base member is adjustable as desired.

3. The portable door lock of claim 1 wherein said base member, said cup mount member, said cup, said first member, said second member, and said central members, being formed from a substantially rigid material.

4. The portable door lock of claim 2 wherein said base member, said cup mount member, said cup, said first member, said second member, and said central members being formed from a substantially rigid material.

* * * * *